US006373439B1

(12) United States Patent
Zürcher et al.

(10) Patent No.: US 6,373,439 B1
(45) Date of Patent: Apr. 16, 2002

(54) STRUCTURE FORMING AN ANTENNA ALSO CONSTITUTING A SHIELDED HOUSING ABLE, IN PARTICULAR, TO ACCOMMODATE ALL OR PART OF THE ELECTRONIC CIRCUIT OF A PORTABLE UNIT OF SMALL VOLUME

(75) Inventors: Jean-François Zürcher, Tavel/Clarens; Olivier Staub, Lausanne; Anja Skrivervik, Champvent, all of (CH)

(73) Assignee: Asulab S.A., Bienne (CH)

( * ) Notice: Subject to any disclaimer, the term of this patent is extended or adjusted under 35 U.S.C. 154(b) by 0 days.

(21) Appl. No.: 09/685,892

(22) Filed: Oct. 11, 2000

(30) Foreign Application Priority Data

Oct. 11, 1999 (EP) ..... 99120230

(51) Int. Cl.[7] ..... H01Q 1/12

(52) U.S. Cl. ..... 343/718; 343/702; 343/829; 343/848

(58) Field of Search ..... 343/702, 700 MS, 343/846, 848, 829, 830, 718, 828

(56) References Cited

U.S. PATENT DOCUMENTS 4,864,320 A 9/1989 Munson ..... 343/833
5,359,340 A 10/1994 Yokota ..... 343/792
6,025,805 A * 2/2000 Smith et al. ..... 343/702
6,130,650 A * 10/2000 Curtis et al. ..... 343/846

FOREIGN PATENT DOCUMENTS

EP 591 913 4/1994 ..... G04G/1/00
FR 2505105 11/1982 ..... H01B/1/08

* cited by examiner

*Primary Examiner*—Don Wong
*Assistant Examiner*—Hoang Nguyen
(74) *Attorney, Agent, or Firm*—Sughrue Mion, PLLC

(57) ABSTRACT

The present invention concerns a structure forming an antenna (10) intended for a portable unit of small volume, such as a timepiece, and including a radiating element (20) of substantially rectangular shape arranged at a determined distance from a ground plane and short-circuited with this ground plane by one (20*b*) of its ends (20*a*, 20*b*), the opposite end (20*a*) of said radiating element (20) being left free. According to the present invention, said structure (10) includes a case (11) forming an integral part of said ground plane and including at least a cover (12), a bottom (14), and a lateral wall (13*b*) facing which is arranged said radiating element (20), said case (11) forming a shielded housing able to accommodate all or part of an electronic circuit and/or other components of the portable unit.

The present invention also concerns a timepiece incorporating the aforementioned antenna structure.

17 Claims, 3 Drawing Sheets

Fig. 1
( PRIOR ART )
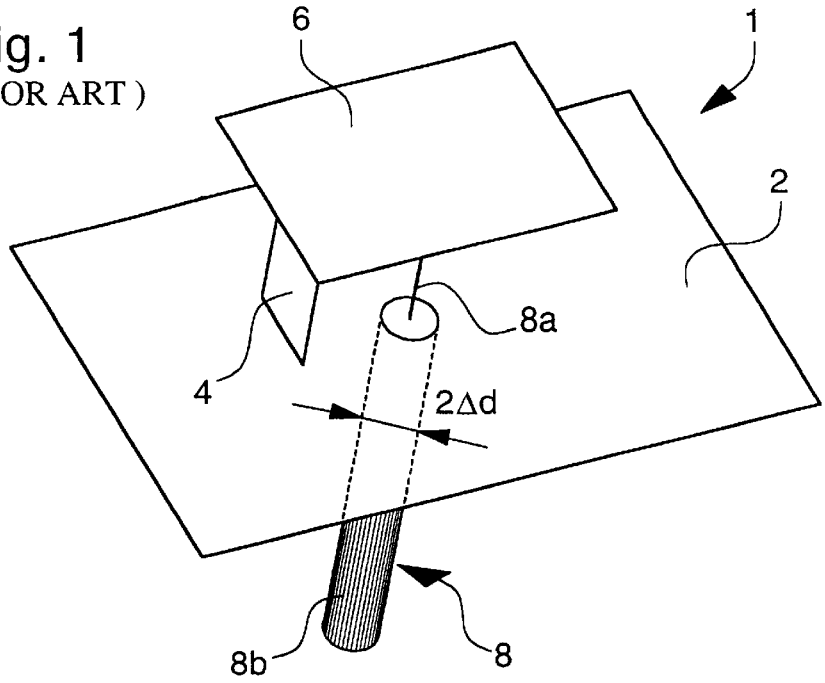
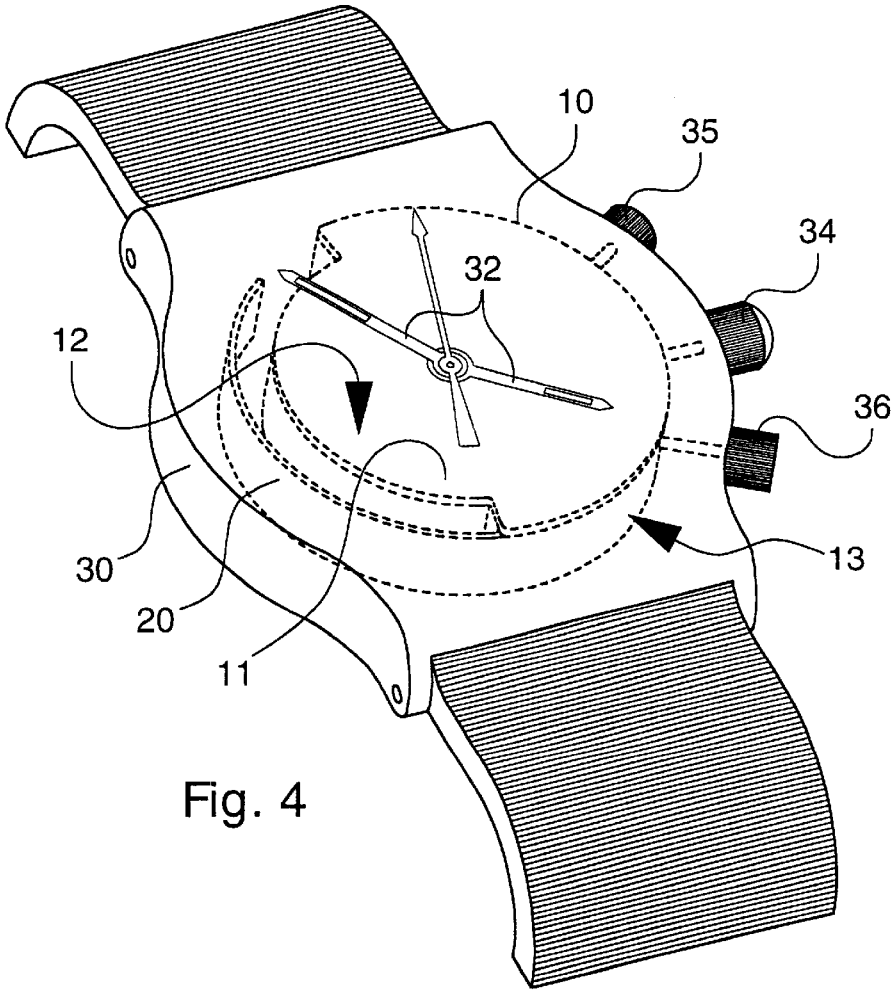
Fig. 4

STRUCTURE FORMING AN ANTENNA ALSO CONSTITUTING A SHIELDED HOUSING ABLE, IN PARTICULAR, TO ACCOMMODATE ALL OR PART OF THE ELECTRONIC CIRCUIT OF A PORTABLE UNIT OF SMALL VOLUME

BACKGROUND OF THE INVENTION.

The present invention concerns generally the field of antennas intended for the transmission and reception of an electromagnetic signal. More particularly, the present invention concerns a structure of small volume forming an antenna derived from a structure known by the name of PIFA or "planar inverted-F antenna" intended to be incorporated in a portable unit of small volume, such as a timepiece. The antenna structure according to the present invention is in particular intended for transmitting and receiving high frequency electromagnetic signals allowing, for example, a radio telephone communication to be assured on a mobile telephone network. The antenna structure according to the present invention may nonetheless be applied in other systems requiring a wireless communication between a portable unit and a remote transmitter/receiver station.

The present invention also concerns a timepiece, such as a watch, adapted to transmit and receive high frequency electromagnetic signals incorporating the aforementioned antenna structure and allowing, for example, a radio telephone communication to be assured with other users on a mobile telephone network.

The continued expansion of radio frequency communication systems and in particular mobile telephone systems, leads to an increasing demand for increasingly compact and light portable communication equipment. Parallel to the technological advances which have allowed the development of electronic circuits and radio circuits of small size and the development of high performance power sources, antennas of small profile adapted to be mounted on portable communication units such as cellular telephones have already been proposed. One such structure is known by the name of planar inverted-F antenna or PIFA.

FIG. 1 illustrates an example of a PIFA structure, indicated globally by the numerical reference 1, such as typically known in the state of the art. This PIFA structure 1 includes a ground plane 2, a radiating element 6 of rectangular shape whose length is approximately equal to $\lambda/4$, where $\lambda$ is the antenna transmission/reception wavelength, arranged substantially parallel to ground plane 2, as well as a short-circuit plate 4 connecting radiating element 6 to ground plane 2 and holding said radiating element 6 at a determined distance with respect to ground plane 2.

This antenna 1 is powered by a transmission line, such as a coaxial line 8, from the back of ground plane 2. This coaxial line 8, arranged at a determined distance from short-circuit plate 4, includes an internal conductor 8*a* passing through ground plane 2 to connect radiating element 6, and an external conductor 8*b* connected to ground plane 2 and at a distance Ad from internal conductor 8*a*.

A detailed analysis of the PIFA structure illustrated in FIG. 1 can be found in the document "Analysis, Design and Measurement of Small and Low-Profile Antennas", Artech House, Norwood, Mass., 1992, Ch. 5, pages 161–180, Kazuhiro Hirasawa and Misao Haneishi, which is incorporated here by reference.

Because of its small profile, this PIFA structure is thus perfectly suited to being mounted on a small communication unit, such as a cellular telephone. This PIFA structure is thus generally mounted on a face of the conductor body of the cellular telephone which also forms the ground plane of the antenna. It will be noted that the features of antenna (resonance frequency, bandwidth. etc.) depend not only on the dimensions of the radiating element and its distance from the ground plane, but also on the dimensions of the conductor body forming the ground plane of the antenna. The shape and dimensions of this body do not constitute very restricting elements in a cellular telephone since the latter nonetheless remains an object of relatively large size with respect, for example, to a portable unit such as a timepiece which is characterised by a substantially smaller volume.

In order to incorporate such an antenna in a portable unit of small volume such as a watch, one has thus to find solutions which advantageously combine compactness and yet performance allowing radio communication to be assured in the best conditions.

SUMMARY OF THE INVENTION

One object of the present invention is thus to propose an antenna easily able to be arranged and mounted inside a portable communication unit of small volume, such as for example, a timepiece.

Another object of the present invention is to propose an antenna answering the aforementioned definition whose structure can be made as easily as possible in order to limit manufacturing costs.

The present invention therefore concerns an antenna structure intended for a portable unit of small volume, such as a timepiece, whose features are listed in claim 1.

Advantageous embodiments of the present invention are the subject of other claims.

The present invention also concerns a timepiece incorporating the aforementioned antenna structure.

One advantage of the present invention lies in the fact that the proposed structure is completely integrated in a structure of small volume which combines compactness, rigidity and aesthetics, the radiating element forming an integral part of a case forming the ground plane of the antenna. The sizing, connection and adaptability of the features of the antenna (frequency, bandwidth, impedance, etc.) are also easy.

The case forming the ground plane of the antenna also advantageously allows all or part of the electronics of the portable communication unit to be housed inside the antenna structure, this case thus forming a shielded housing inside which the electronic circuit is protected and in no way affects the performance of the antenna. The proposed antenna can thus very advantageously be powered from the inside of the housing thereby formed.

The proposed structure also combines the ground plane of the antenna and a housing allowing not only the electronic circuit of the portable unit but also any other components which may be present in said unit to be accommodated. The structure according to the present invention may thus advantageously form a watch case also allowing a timepiece movement to be accommodated.

If aesthetic criteria so demand, the structure may also be easily surrounded by or embedded in an external plastic element. This external element may thus take various forms, such as for example, the form of a middle part of a watch.

The radiating element of the antenna is small electrically, but the influence of the complete structure (including the case) determines the antenna's radiation properties. Associated with small losses due to the absence of a dielectric between the radiating element and the ground plane, or more exactly to the presence of a dielectric formed solely by air, this leads to remarkable antenna gain and efficiency.

BRIEF DESCRIPTION OF THE DRAWINGS

Other features and advantages of the invention will appear more clearly upon reading the following detailed description, made with reference to the annexed drawings, given by way of non limiting example and in which:

FIG. 1, which has already been presented, illustrates a known PIFA structure;

FIG. 4 shows a schematic perspective view of a timepiece incorporating the antenna structure forming the antenna illustrated in FIGS. 2*a* and 2*b*.

DETAILED DESCRIPTION OF THE INVENTION

The present invention will now be described with reference to different embodiments. It will be noted however that those skilled in the art will be perfectly capable of modifying and adapting the structures presented to make them take varied forms according to the type of application and the design restrictions imposed, without however departing from the scope of the invention defined by the annexed claims.

The structure which will be described in the following part of the present description with reference to FIGS. 2*a* and 2*b* constitutes a preferred embodiment of an antenna structure which may advantageously be incorporated in a timepiece provided with a radio telephone function. With reference to FIG. 4, a schematic example of a timepiece incorporating the structure illustrated in FIGS. 2*a* and 2*b* will thus be presented hereinafter.

Figure 2A:
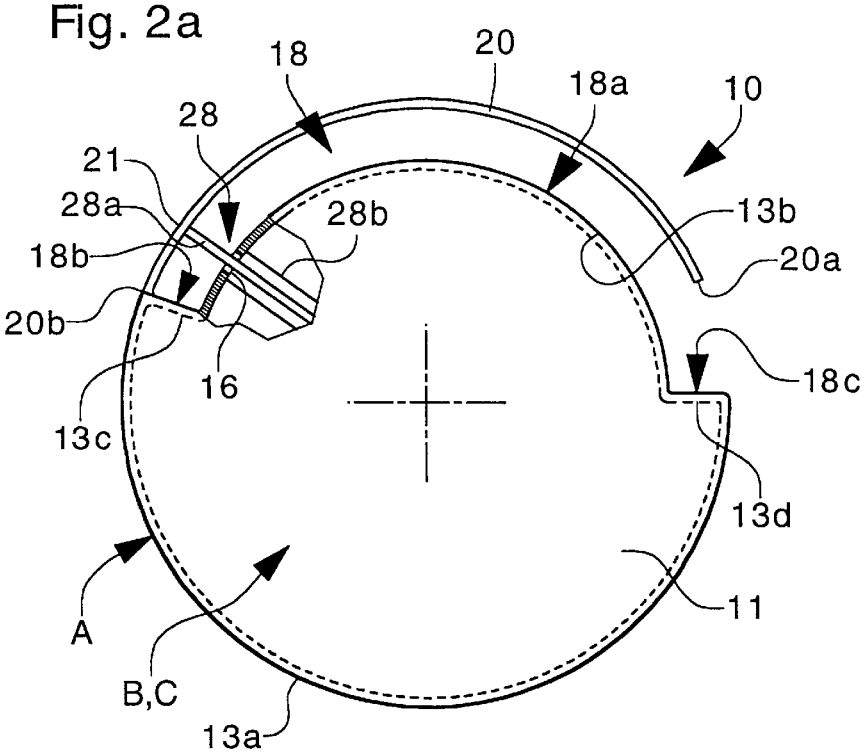
FIGS. 2*a* and 2*b* show respectively a face view and a blown up perspective view of a preferred embodiment of an antenna structure according to the present invention.
Figure 2B:
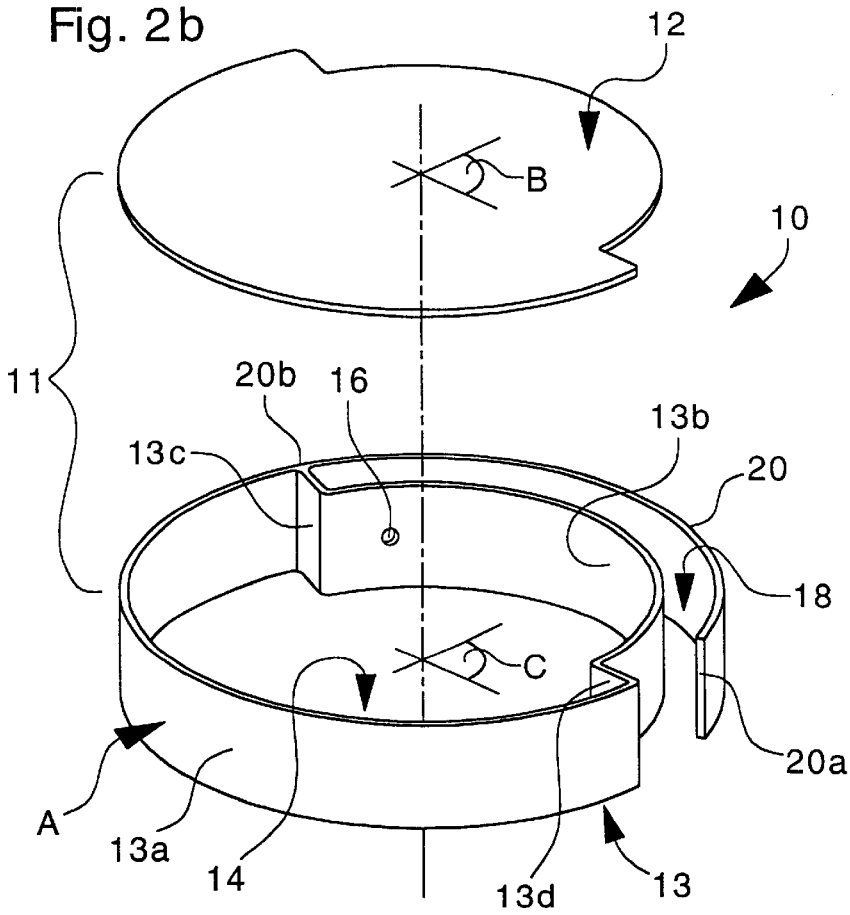

FIGS. 2*a* and 2*b* thus respectively show a face view and a blown up perspective view of an antenna structure constituting a preferred embodiment of the present invention. This antenna structure, indicated generally by the numerical reference 10, is made of a conductor material and essentially has the appearance, in this example, of a cylinder portion delimited by a substantially cylindrical contour A, and first and second planes B and C substantially perpendicular to the axis of symmetry of the cylinder, perpendicular to the plane of FIG. 2*a* and indicated in dotted lines in FIG. 2*b*.

According to the present invention, this antenna structure 10 includes a radiating element 20, of substantially rectangular shape or surface, secured to a case 11 forming an integral part of the ground plane of the antenna. As can be seen from the Figures, case 11 is preferably made in two parts 12 and 13, one part 12 essentially forming a cover for case 11, and the other 13 essentially forming a body of case 11 and further supporting radiating element 20. Body 13 of case 11 includes a bottom 14 and a set of lateral walls 13*a* to 13*d*, and thus defines, with cover 12, a shielded housing capable of accommodating various components, such as the electronic circuit necessary for the antenna to operate. In particular, the radio frequency electronic circuit necessary for the transmission and reception of the electromagnetic signals and any electronic element which could potentially influence or be influenced by the transmission or reception of these electromagnetic signals could be arranged in case 11. If space allows or requires, any other electronic or non electronic component may be arranged inside the case, such as, for example, a timepiece movement and/or a power source for the portable unit.

Radiating element 20 has a profile of an arc of a circle and is arranged on the side of case 11, or more specifically on the cylindrical contour A of structure 10. This radiating element 20 is linked by one 20*b* of its ends to body 13 of case 11, and is thus short-circuited, by this same end 20*b*, with the ground plane of the antenna formed by case 11, the opposite end 20*a* of radiating element 20 being left free. The length of radiating element 20 between free end 20*a* and short-circuited end 20*b* is approximately equal to a quarter of the antenna's transmission/reception wavelength $\lambda$.

There is a radial recess 18 having the shape of an arc of a circle between radiating element 20 and case 11 of the structure. This radial recess 18 defines, on case 11, a surface shaped like an arc of a circle 18*a* concentric to cylindrical contour A of the structure and two substantially planar surfaces 18*b* and 18*c* extending radially between surface 18*a* and cylindrical contour A of the structure. Case 11 thus includes two cylindrical lateral walls 13*a* and 13*b* respectively defined by cylindrical contour A and arc of a circle surface 18*a* of radial recess 18, and two planar lateral walls 13*c* and 13*d* defined by plane surfaces 18*b* and 18*c*.

Radial element 20 is thus arranged on cylindrical contour A of structure 10 facing cylindrical lateral wall 13*b*, short-circuited end 20*b* of this radiating element 20 being connected to the angle formed by cylindrical lateral wall 13*a* and planar lateral wall 13*c*. Free end 20*a* of radiating element 20 points in the direction of the angle formed by cylindrical lateral wall 13*a* and planar lateral wall 13*d*.

In this embodiment, antenna structure 10 thus has a generally cylindrical appearance, the contour of this structure being interrupted only by the space left between free end 20*a* of the radiating element and the angle formed by cylindrical lateral wall 13*a* and planar lateral wall 13*d* of body 13 of case 11. The cylindrical contour of the structure can thus advantageously play the role of a casing ring allowing the structure to be easily inserted into an external element of the portable unit, such as the middle part of a watch.

Excitation of the antenna can be achieved in a conventional manner by a transmission line, such as a coaxial line, from the inside of case 11. As is for example illustrated in FIG. 2*a*, the antenna can be excited by a coaxial line 28 whose internal conductor 28*a*, insulated from the ground plane, passes through cylindrical lateral wall 13*b* through an orifice 16 arranged therein to contact radial element 20 at a determined point 21 distant from short-circuited end 20*b*, and whose external conductor 28*b* contacts the inner face of cylindrical lateral wall 13*b*.

By playing with the dimensions of the structure, one acts on the features of the antenna. One could, in particular, act on the distance between radiating element 20 and arc of a circle surface 18*a* as well as on the global dimensions of case 11 to modify the antenna's bandwidth. One could also act on the length and width of radiating element 20 in order to modify its resonant frequency.

According to this embodiment of the present invention, an antenna structure has thus been conceived which is suited to transmit and receive electromagnetic signals at a frequency of 1.8 Ghz whose external diameter is of the order of 35 mm and whose total thickness is approximately 10 mm, these dimensions perfectly well allowing the incorporation of the structure in a timepiece. According to this embodiment, radiating element 20 of the antenna thus extends over cylindrical contour A of the structure in an arc of a circle of approximately 136° and is arranged at a distance of the order of 3 mm facing cylindrical lateral wall 13*b* of body 13 of case 11.

The antenna structure is preferably made of a metallic material, such as brass, but may alternatively also be made of a dielectric material, such as a plastic, coated with an electrically conductive material, This structure may be made by different manufacturing and machining techniques known to those skilled in the art, such as moulding, drawing or drilling, for example.

Figure 3A:
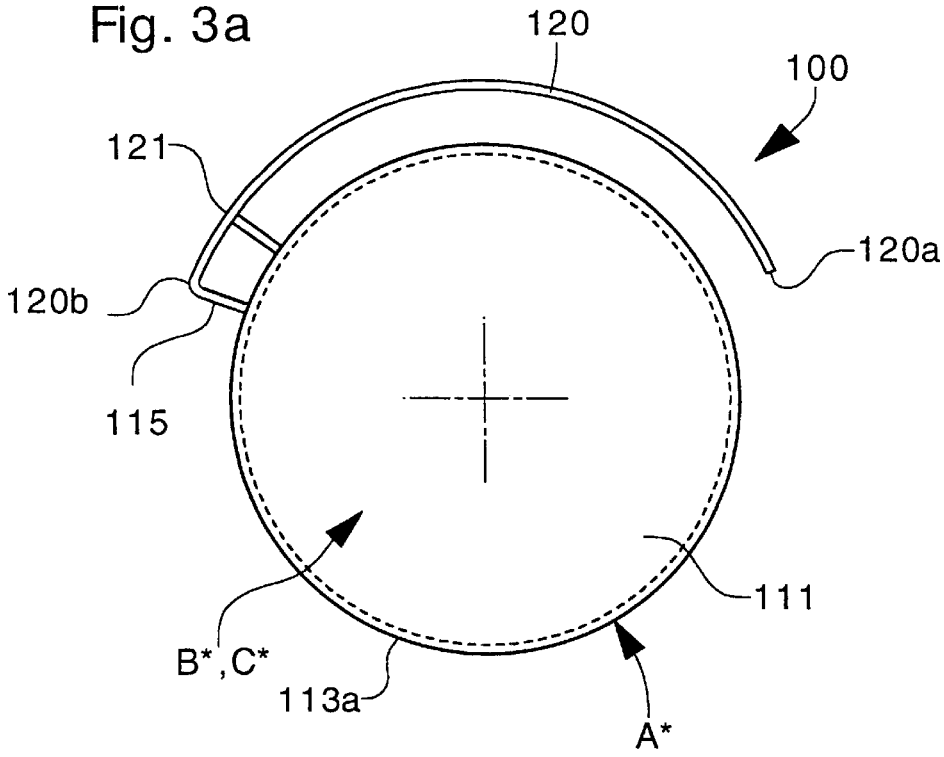
FIGS. 3*a* and 3*b* show respectively a face view and a blown up perspective view of another embodiment of an antenna structure according to the present invention.
Figure 3B:
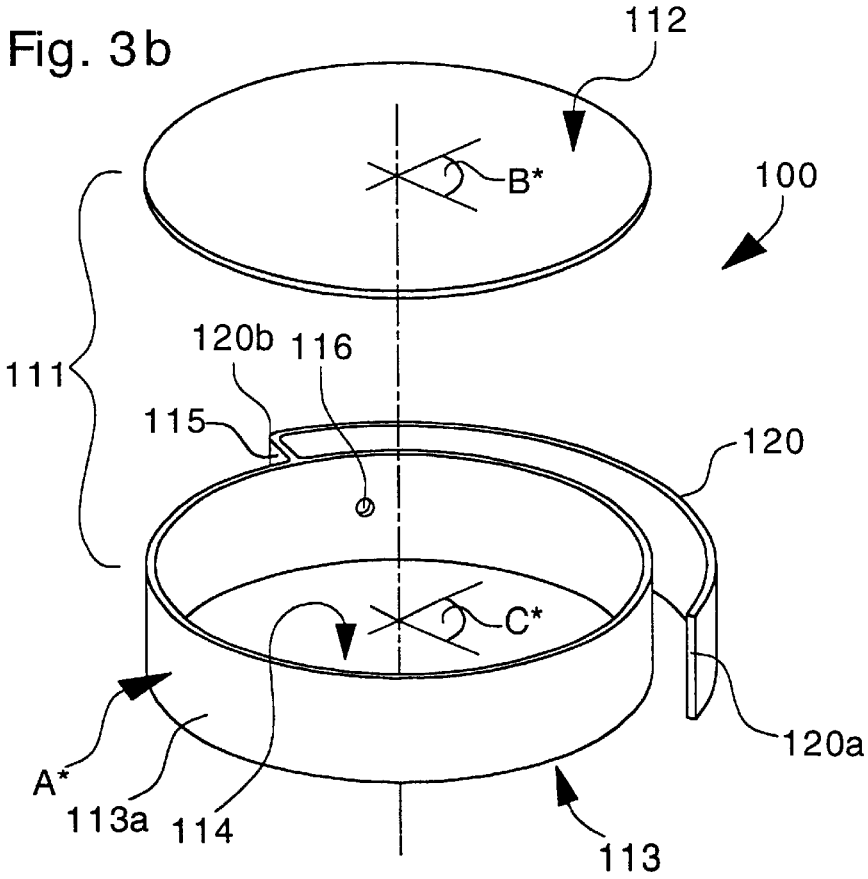

FIGS. 3*a* and 3*b* respectively show a face view and a blown up perspective view of an antenna structure, indicated generally by the numerical reference 100, constituting another embodiment of the present invention. In this other embodiment, antenna structure 100 includes a radiating element 120, of substantially rectangular shape or surface, secured to a case 111 forming an integral part of the ground plane of the antenna. This case 111 essentially has the appearance, in this example, of a cylinder portion delimited by a substantially cylindrical contour A*, and first and second planes B* and C* substantially perpendicular to the axis of symmetry of the cylinder, perpendicular to the plane of FIG. 3*a* and indicated in dotted lines in FIG. 3*b*.

As can be seen in the Figures, case 111 is made in two parts 112 and 113, one part 112 essentially forming a cover for case 111, and the other 113 essentially forming a body of case 111 and also supporting radiating element 120. Body 113 of case 11 includes a bottom 114 and a cylindrical lateral wall 113*a*, and thus defines, with cover 112, a shielded housing capable of receiving, in a similar way to the preceding embodiment, various components of the portable unit in which it is incorporated.

Unlike the preceding embodiment, radiating element 120 is arranged on a circle concentric to cylindrical contour A* beyond cylindrical lateral wall 113*a* of body 113 of the case. An element 115 extending substantially radially between cylindrical lateral wall 113*a* and one end 120*b* of radiating element 120 assures the short-circuiting of the latter with the ground plane formed by the case. The other end 120*a* of radiating element 120 is left free.

Excitation of the antenna can be achieved in a similar way to the embodiment illustrated in FIGS. 2*a* and 2*b* via a coaxial line whose internal conductor, insulated from the ground plane, passes through cylindrical lateral wall 113 through an orifice 116 arranged therein to contact radiating element 120 at a determined point 121 distant from short-circuited end 120*b*, and whose external conductor contacts the inner face of cylindrical lateral wall 113 of case 111.

Although the embodiments which have just been illustrated have a generally cylindrical appearance which is typically suited to a horological use, it will be understood that the antenna structure according to the present invention can take varied forms according to the constraints as to space requirement of the portable unit in which this structure is incorporated. The antenna structure can thus perfectly have a substantially elliptical, polygonal, or rectangular shape.

FIG. 4 shows a schematic perspective view of a timepiece having the form of a wristwatch having an analogue display illustrating the possibility of incorporating antenna structure 10 illustrated in FIGS. 2*a* and 2*b*. Structure 10 is thus surrounded and incorporated in an external element made of a non conductor material such as a plastic material having the form of a middle part of a watch, designated by the numerical reference 30 in the Figure. The movement, not shown, of the timepiece is advantageously arranged entirely inside antenna structure 10.

Orifices of small diameter can perfectly well be arranged in case 11 of antenna structure 10 without substantially affecting the features thereof, so as to allow the passage, if necessary, of constituent elements of display and/or control components, these elements being necessarily insulated from structure 10. In the example of FIG. 4, shafts or pipes of the hour and minute hands 32 thus pass through the centre of cover 12 of case 11 of the structure. Likewise, stems of various control elements penetrate laterally through the cylindrical lateral wall (cylindrical lateral wall 13*a* in FIGS. 2*a* and 2*b*) of body 13 of the case of structure 10, these control elements including in particular a rotating stem secured to a time-setting crown 34 and two push buttons 35 and 36.

It will of course be understood that antenna structure 10 is preferably arranged in watch middle part 30 so that radiating element 20 is oriented in the opposite direction to control elements 34, 35 or 36, or generally, opposite any element penetrating the interior of the case of antenna structure 10.

According to the present invention, a structure forming an antenna may thus be made so as to be incorporated in a timepiece, such as a watch, and to accommodate, inside the shielded housing, all or part of the radio frequency electronic circuit, the electronic circuit of the timepiece and its movement.

It will be understood that different modifications and/or adaptations may be made to the antenna structure without departing from the scope of the present invention defined by the annexed claims. In particular, according to the desired feature of the antenna, the radiating element may or may not extend over the entire thickness of the structure and may or may not be short-circuited with the ground plane over the entire length of its end linked to the case.

What is claimed is:

1. An antenna structure intended for a portable unit of small volume, and including a radiating element of substantially rectangular surface arranged at a determined distance from a ground plane and short-circuited with this ground plane by one of its ends, the opposite end of said radiating element being left free, wherein said structure includes a case forming an integral part of said ground plane and including at least a cover, a bottom, and a lateral wall, said radiating element being disposed laterally with respect to said case in-between said cover and bottom, the surface of said radiating element facing said lateral wall, said case forming a shielded housing able to accommodate all or part of an electronic circuit and/or other components of the portable unit.

2. An antenna structure according to claim 1, wherein said antenna structure essentially has the shape of a cylinder portion delimited by a substantially cylindrical contour defining a cylindrical lateral wall of said case, and by first and second planes respectively defining said cover and said bottom of the case, and wherein said radiating element substantially has a profile of an arc of a circle concentric to said cylindrical contour, and is arranged in the vicinity of said cylindrical contour in-between said first and second planes.

3. An antenna structure according to claim 2, wherein a radial recess having the shape of an arc of a circle concentric to said cylindrical contour separates said radiating element from said case, this radial element defining, on said case, another cylindrical lateral wall concentric to and of smaller radius than said cylindrical contour, and two planar lateral walls extending substantially radially between the two cylindrical lateral walls of the case, said radiating element being arranged on said cylindrical contour facing and at a determined distance from said other cylindrical lateral wall, the short-circuited end of this radiating element being connected to the angle formed by the cylindrical lateral wall and one of said planar lateral walls.

4. An antenna structure according to claim 2, wherein said radiating element is arranged beyond said cylindrical contour facing and at a determined distance from said cylindrical lateral wall of said case, the short-circuited end of the radiating element being connected to an element extending substantially radially from said cylindrical lateral wall of said case.

5. An antenna structure according to claim 1, wherein excitation of the antenna is assured by a transmission line, such as a coaxial line, from the interior of said case, this coaxial line including an internal conductor insulated from the ground plane and contacting said radiating element at a determined point distant from the short-circuited end, and an external conductor contacting the ground plane.

6. An antenna structure according to claim 1, wherein said antenna structure is made of a metallic material.

7. An antenna structure according to claim 1, wherein said antenna structure is made of a dielectric material coated with an electrically conductive layer.

8. An antenna structure according to claim 1, wherein said lateral wall forms a casing ring of a timepiece.

9. An antenna structure according to claim 1, wherein said radiating element forms an integral part of said case.

10. A timepiece comprising an antenna structure including a radiating element of substantially rectangular surface arranged at a determined distance from a ground plane and short-circuited with this ground plane by one of its ends, the opposite end of said radiating element being left free, wherein said antenna structure includes a case forming an integral part of said ground plane and including at least a cover, a bottom, and a lateral wall, said radiating element being disposed laterally with respect to said case in-between said cover and bottom, the surface of said radiating element facing said lateral wall, said case forming a shielded housing able to accommodate all or part of an electronic circuit and/or other components of the timepiece.

11. A timepiece according to claim 10, wherein said antenna structure essentially has the shape of a cylinder portion delimited by a substantially cylindrical contour defining a cylindrical lateral wall of said case, and by first and second planes respectively defining said cover and said bottom of the case, and wherein said radiating element substantially has a profile of an arc of a circle concentric to said cylindrical contour and is arranged in the vicinity of said cylindrical contour in-between said first and second planes.

12. A timepiece according to claim 10, wherein said lateral wall also forms a casing ring of the timepiece.

13. A timepiece according to claim 10, wherein said case is incorporated in an external element made of a non conductive material, such as a plastic material, and which has the form of a watch middle part.

14. A timepiece according to claim 10, wherein a watch movement is disposed inside said case.

15. A timepiece according to claim 14, wherein shafts or pipes of hour and minute hands are arranged to pass through said cover.

16. A timepiece according to claim 14, wherein stems of control elements, such as a time-setting crown or a push button, penetrate laterally through said lateral wall.

17. A timepiece according to claim 16, wherein said radiating element is oriented in a substantially opposite direction to said control elements.

* * * * *